US005125639A

United States Patent [19]

Henn

[11] Patent Number: 5,125,639

[45] Date of Patent: Jun. 30, 1992

[54] SHEET DELIVERY FOR A SHEET-FED PRINTING MACHINE

[75] Inventor: Manfred Henn, Heidelberg, Fed. Rep. of Germany

[73] Assignee: Heidelberger Druckmaschinen AG, Heidelberg, Fed. Rep. of Germany

[21] Appl. No.: 613,404

[22] Filed: Nov. 15, 1990

[30] Foreign Application Priority Data

Nov. 15, 1989 [DE] Fed. Rep. of Germany ..... 3937944

[51] Int. Cl.[5] ..... B65H 29/34

[52] U.S. Cl. ..... 271/189; 271/213; 271/220; 414/789.1; 414/790.8

[58] Field of Search ..... 271/189, 207, 213, 218, 271/220, 221; 414/789.1, 790.8, 788.9

[56] References Cited

U.S. PATENT DOCUMENTS

| | | | |
|---|---|---|---|
| 2,631,038 | 3/1953 | Wood et al. | 271/218 |
| 3,966,195 | 6/1976 | Simeth | 271/189 |
| 3,972,524 | 8/1976 | Despot et al. | 271/218 |
| 4,469,321 | 9/1984 | Geschwindner | 271/218 X |

FOREIGN PATENT DOCUMENTS

| | | |
|---|---|---|
| 1761449 | 3/1973 | Fed. Rep. of Germany . |
| 1230456 | 5/1991 | Fed. Rep. of Germany . |

*Primary Examiner*—David H. Bollinger
*Attorney, Agent, or Firm*—Herbert L. Lerner; Laurence A. Greenberg

[57] ABSTRACT

A sheet delivery for a sheet-fed printing machine having foldaway pile steps for engagement by a leading edge of a sheet travelling from the sheet-fed printing machine to a location above a sheet pile and removable collecting fingers insertable substantially rectilinearly for a brief period above the sheet pile so as to extend from the leading edge of the sheet, parallel to the plane of the sheet, for forming an auxiliary pile, includes a first motorized drive for moving the pile stops, and a second motorized drive for moving the collecting fingers, each of the first and second motorized drives being disposed on a respective one of two machine sides of the sheet delivery, coaxially mounted first and second drive shafts disposed transversely to the direction of travel of the sheet, a first transmission device operatively connecting the first motorized drive with the first drive shaft for rotating the first drive shaft, the first transmission device being disposed on one of the machine sides, and a second transmission device operatively connecting the second motorized drive with the second drive shaft for rotating the second drive shaft and thereby guidingly displacing the collecting fingers substantially rectilinearly, the second transmission device being disposed on the other of the machine sides, and a switching device for the first and second motorized drives for independently driving the first and second drive shafts individually, as well as for correspondingly driving the first and second drive shafts in mutual dependence.

5 Claims, 4 Drawing Sheets

SHEET DELIVERY FOR A SHEET-FED PRINTING MACHINE

Figure 1:
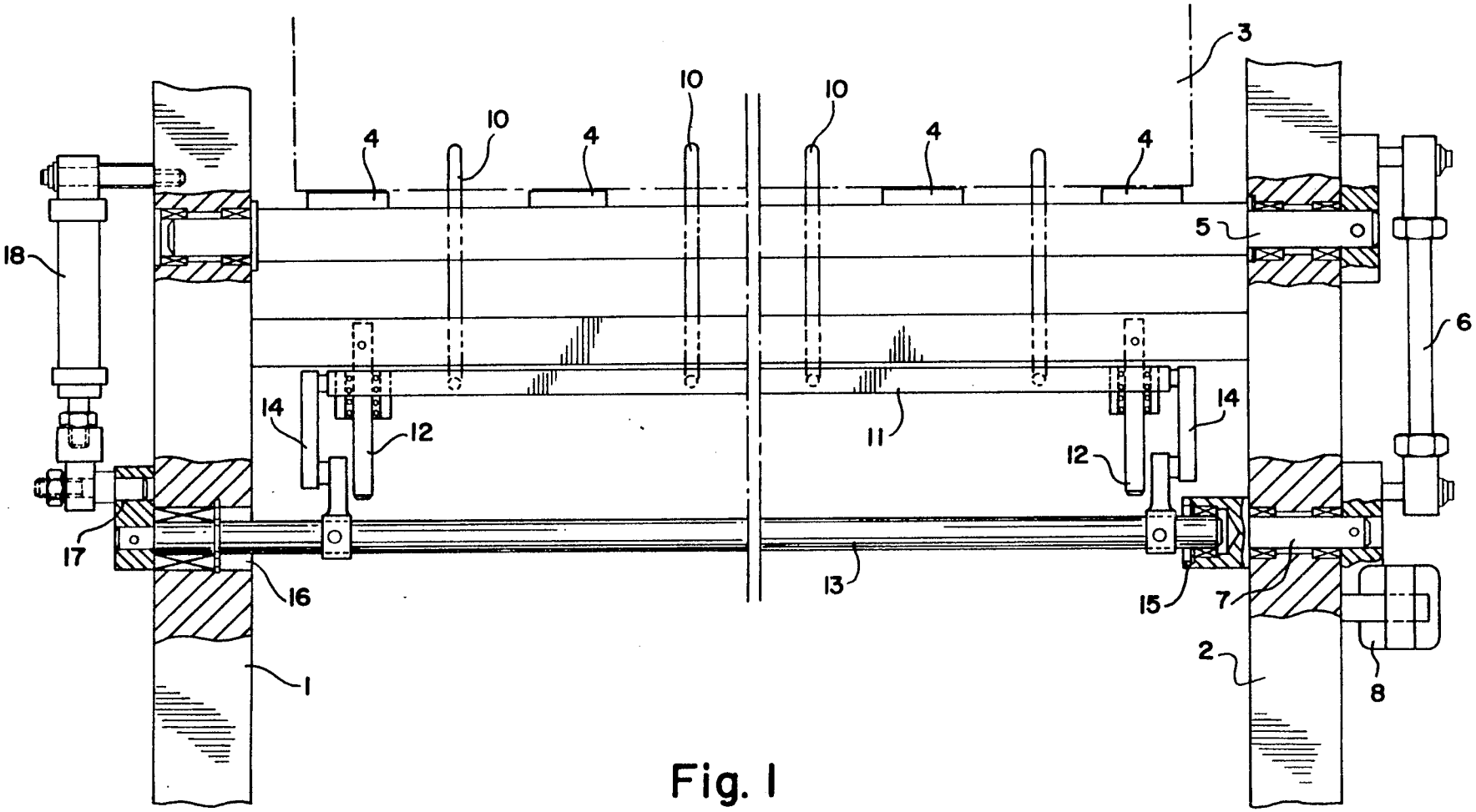

The invention relates to a sheet delivery for a sheet-fed printing machine and, more particularly, to such a sheet delivery having fold-away pile stops for engagement by a leading edge of a sheet travelling from the sheet-fed printing machine to a location above a sheet pile, and removable collecting fingers insertable substantially rectilinearly for a brief period above the sheet pile so as to extend from the leading edge of the sheet, parallel to the plane of the sheet, for forming an auxiliary pile, a swivel shaft oriented parallel to the plane of the sheet and carrying the pile stops, and corresponding drive members for folding the pile stops away and folding them out again in accordance with an inserting movement and a withdrawal movement, respectively, of the collecting fingers.

A sheet delivery of this general type has become known heretofore from German Patent (DE-PS) 23 01 840. The construction characteristics of this conventional device facilitate, on the one hand, the removal of a test sheet and, on the other hand, the insertion of an auxiliary piling device or stacker, for example a pile rack or board or the like, in order to be able to exchange the sheet pile in the sheet delivery during non-stop operation. In the sheet delivery known from this German patent, sheets are transported out of the sheet-fed printing machine by endless continuously revolving chain conveyors with the leading edge of the sheet disposed against the pile stops, which are positioned so that they can be folded away, and are deposited on the sheet pile. In order to remove test sheets and to form an auxiliary pile during non-stop operation, use is made of the collecting or catching fingers, which are insertable for a brief period from the leading edge of the sheet over the sheet pile, and are disposed on one arm of an angle lever. The other arm of this angle lever is connected via a resilient or springy connecting element to a swivel arm, which is seated on a swivel shaft for the pile stops, the swivel shaft being swivellable by a manual lever. so that the movement of the collecting fingers and the pile stops may be effected in the required dependence upon one another. A set of parallel guide rods transforms the rotary motion of the swivel shaft into an insertion movement, in which, although the collecting fingers retain their horizontal position, they nevertheless move in the travel path of the sheet which adversely affects the operational reliability of the device. When the collecting fingers are inserted and, after a delay with respect to this action, the pile stops have been folded or flapped away, a test sheet may be removed from the pile, or an auxiliary device for forming an auxiliary pile may be inserted while the main sheet pile is being exchanged in a non-stop operation.

In a particular construction of this heretofore known device, the movement of the collecting fingers is motorized by a pneumatic cylinder having a movement which is, however, controlled via a switching element by the manual lever operating the swivel shaft for the pile stops, in order, once again, to achieve the mutual dependence of the movements of the pile stops and the collecting fingers.

From German Patent (DE-PS) 17 61 449, a sheet delivery has become known heretofore which has a collecting device for the leading or front edge of the sheet, the collecting fingers being swivellable via miter gears about horizontal axes, so that, although a lever guide for ensuring the most possible rectilinear collecting-finger movement parallel to the plane of the oncoming sheets is dispensed with, the folding movement of the pile stops in this device, which can also be operated by a manual lever, nevertheless begins simultaneously with the swivelling movement of the collecting fingers, so that, with respect to fast-running machines, in particular, there is considerable danger of sheets slipping through during the switchover.

It is accordingly an object of the invention to provide a sheet delivery of the foregoing general type which, while further improved in operational reliability, exhibits more precise sequences of movement with higher speeds of movement during the removal of test sheets or during pile exchange, and wherein a movement of the collecting fingers and of the pile stops, respectively, independently of one another is possible with motorized drives.

With the foregoing and other objects in view, there is provided, in accordance with the invention, a sheet delivery for a sheet-fed printing machine having fold-away pile stops for engagement by a leading edge of a sheet travelling from the sheet-fed printing machine to a location above a sheet pile, and removable collecting fingers insertable substantially rectilinearly for a brief period above the sheet pile so as to extend from the leading edge of the sheet, parallel to the plane of the sheet, for forming an auxiliary pile, a swivel shaft oriented parallel to the plane of the sheet and carrying the pile stops, and corresponding drive members for folding the pile stops away and folding them out again in accordance with an inserting movement and a withdrawal movement, respectively, of the collecting fingers, comprising a first motorized drive for moving the pile stops, and a second motorized drive for moving the collecting fingers, each of the first and second motorized drives being disposed on a respective one of two machine sides of the sheet delivery, coaxially mounted first and second drive shafts disposed transversely to the direction of travel of the sheet, first transmission means operatively connecting the first motorized drive with the first drive shaft for rotating the first drive shaft, the first transmission means being disposed on one of the machine sides, and second transmission means operatively connecting the second motorized drive with the second drive shaft for rotating the second drive shaft and thereby guidingly displacing the collecting fingers substantially rectilinearly, the second transmission means being disposed on the other of the machine sides, and switching means for the first and second motorized drives for independently driving the first and second drive shafts individually, as well as for correspondingly driving the first and second drive shafts in mutual dependence.

In accordance with another feature of the invention, there is provided a first frame wall located at the one machine side, the first drive shaft being mounted in the first frame wall and having a first journal bearing wherein one end of the second drive shaft is mounted coaxially with the first drive shaft, and a second frame wall located at the other machine side and having a second journal bearing therein for supporting the other end of the second drive shaft In accordance with a further feature of the invention, the first journal bearing is common to both the first and the second drive shafts, the first journal bearing being disposed directly adjacent to the first frame wall.

In accordance with an added feature of the invention, the motorized drives are pneumatic cylinders of substantially like dimensions.

In accordance with a concomitant feature of the invention, there are provided a support beam connecting the collecting fingers to one another, the support beam being movably guidable rectilinearly, parallel to the plane of a topmost sheet in the sheet pile, and an articulating lever connecting the support beam to the second drive shaft.

The employment of motorized drives separately for the pile stops, on the one hand, and for movement of the collecting fingers, on the other hand, facilitates the use of simple switching elements for the necessarily mutually dependent control of the movement, and for the individual control of each of the two movement operations. It is thus also possible, in particular for each of the motorized drives, respectively, to be disposed on one of the two machine sides of the delivery and, in fact, at the outside of the machine frame, thereby dispensing with accommodating them in an interior region of the sheet delivery between the lateral frame walls, which is usually very restricted in machines of modern types of construction. The motorized drives, respectively, act directly on the shaft, the angular movement of which is transmitted to the desired extent by transmission members and, in the case of the collecting fingers, is transformed into a linear thrust movement, so that the collecting fingers can be guided in their movement exactly parallel to the plane of the sheets in the sheet pile. In this regard, it is advantageous that angular movements of the drive shafts, which are already small, can be translated into relatively large adjustment movements through suitable transmission by the transmission members. By mounting the two drive shafts coaxially to one another, the number of components is reduced despite the positioning of the motorized drives on separate sides outside of the machine frame, and the accommodation of the components in the tightest possible space is promoted. Pneumatic cylinders are particularly suitable for the motorized drives because they can be readily connected to the available energy system.

Other features which are considered as characteristic for the invention are set forth in the appended claims.

Although the invention is illustrated and described herein as embodied in a sheet delivery for a sheet-fed printing machine, it is nevertheless not intended to be limited to the details shown, since various modifications and structural changes may be made therein without departing from the spirit of the invention and within the scope and range of equivalents of the claims.

Figure 1A:
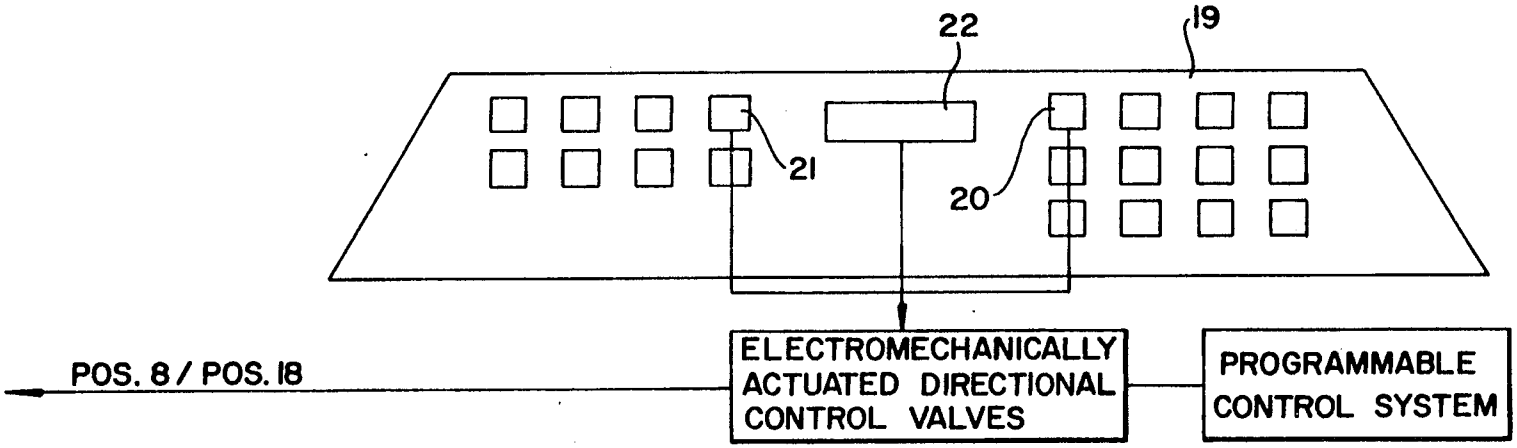
Figure 2:
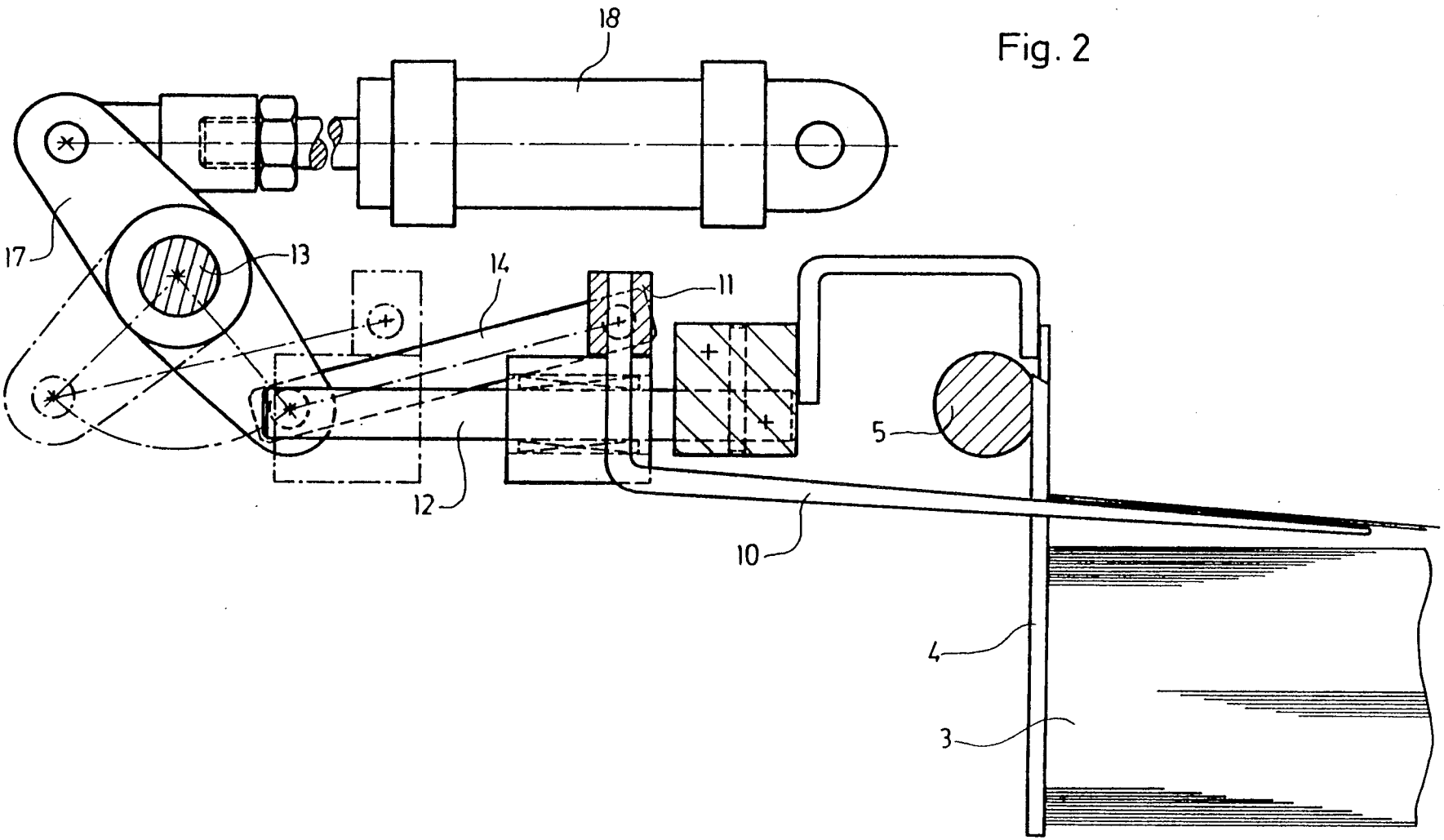
Figure 3:
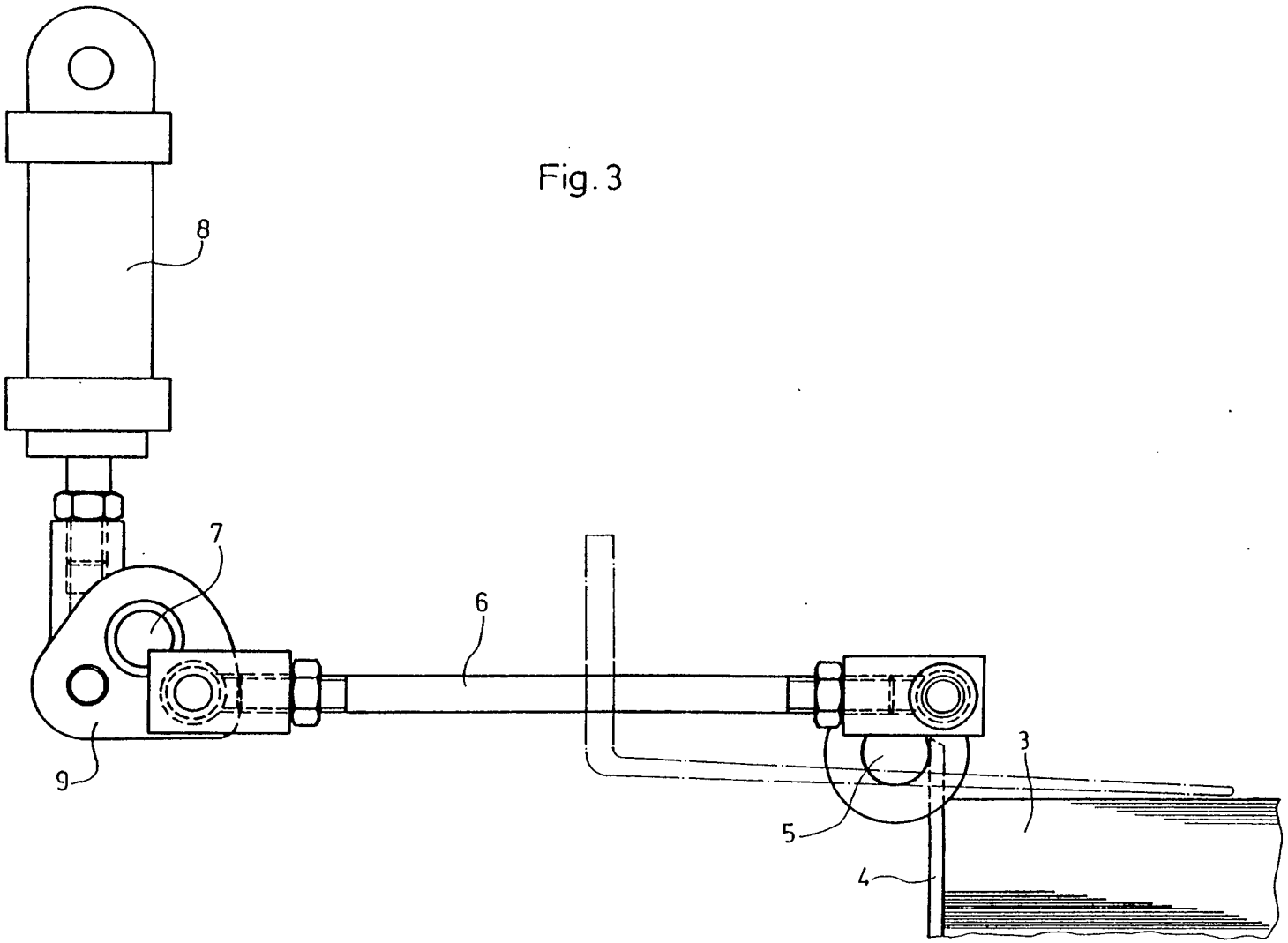

The construction and method of operation of the invention, however, together with additional objects and advantages thereof will be best understood from the following description of specific embodiments when read in connection with the accompanying drawings, in which:

FIG. 1 is a top plan view of a sheet delivery showing catching or collecting fingers and pile stops for leading edges of sheets with appertaining drives, the collecting fingers being in inserted position;

FIG. 1*a* is a diagrammatic and schematic top plan view of a control panel;

FIG. 2 is a side elevational view of a drive for the collecting fingers; and FIG. 3 is a side elevational view of a drive for the pile stops.

Referring now to the drawing and, first, particularly to FIG. 1 thereof, there are shown therein two lateral walls 1 and 2 of the frame of a sheet delivery of a sheet-fed printing machine. In the sheet delivery, the sheets arriving from the sheet-fed printing machine are transported to a location over a sheet pile 3, and are deposited on the sheet pile. The oncoming sheets are transported by the leading edge thereof until they are opposite pile stops 4, several of which are arranged adjacent and spaced from one another. The pile stops 4 are fastened to a transversely extended swivel shaft 5, which is rotatably mounted in the lateral walls 1 and 2 of the frame, so that the pile stops 4 can be flapped or folded away and again flapped or folded out by a rotational movement of the swivel shaft 5. The swivel shaft 5 extends on one side of the machine to the outside of or beyond the lateral wall 2. The end of the swivel shaft 5 on that side is connected via transmission members 6 with a drive shaft 7, which has a motorized drive formed of a pneumatic cylinder 8, and a connection with the latter which is eccentric relative to the axis of the shaft, as shown more clearly in FIG. 3. Between the drive shaft 7 and the pneumatic cylinder 8, an eccentrically disposed connecting piece or stub head 9 is, furthermore, active, a graduated thrust movement or propulsion being intermittently transmitted thereby to the pile stops 4. The bilaterally active pneumatic cylinder 8 enables the pile stops 4 to be folded or flapped away and to be folded or flapped out again.

For the purpose of removing one or more test sheets from the sheet pile 3, or for forming an auxiliary pile during pile exchange when the machine is in non-stop operation, catching or collecting fingers 10 are fastened to a support or beam 11 over a width of the pile, and guided for reciprocating movement in guide channels oriented parallel to the plane of the sheets in the sheet pile 3, so that the collecting fingers 10, in their movement, execute a precisely defined linear motion. The drive for the collecting fingers is provided also by means of a drive shaft 13, which is articulatingly connected to the beam or support 11 by means of articulated levers 14, and is journalled coaxially with the drive shaft 7 for the pile stops. The coaxial mounting or journalling is made possible by the fact that one end of the drive shaft 13, directly adjacent to one lateral wall 2 of the frame, is rotatably mounted or journalled in a bearing 15 provided at an end face of the drive shaft 7, while the other end of the drive shaft 13 has a bearing or journal 16 in the opposite lateral wall 1. The end of the drive shaft 13 which protrudes from the wall 1 is connected by means of a transmission member 17, on this side of the machine, with a pneumatic cylinder 18 for the motorized drive of the drive shaft 13. The transmission member 17 is constructed as a double lever, one arm of which is articulatingly connected to the pneumatic cylinder 18, and the other arm of which is articulatingly connected to the articulated lever 14. Each of the two pneumatic cylinder 8 and 18 is, for example, actuatable in itself by means of switches 20 and 21 on a control panel 19. The two pneumatic cylinders 8 and 18 may, however, also be actuated mutually dependent upon one another by means of a switch 22, so that the collecting fingers 10 are inserted only over the pile before the pile stops 4 are folded away, in order then to remove one or more test sheets from the pile 3. On the other hand, the individual actuation of the pneumatic cylinders 8 and 18 permits, for example, during pile exchange in non-stop operation, first the collecting fingers 10 to be inserted and, only thereafter, the auxiliary piling unit, for example a rack, an auxiliary pile table or board or the like, to be inserted, before the pile stops 4 are folded away for the exchange of the pile 3. Conversely, the pile stops 4 can then first be folded away again, before the auxiliary pile is released and the collecting fingers are withdrawn. This represents a considerable improvement in handling and operational reliability. It is clear from the drawing that the space-taking components for actuating the pile stops 4 and the collecting fingers 10 are arranged outside of the lateral walls 1 and 2 of the frame of the sheet delivery. The transmission of the motorized drive forces to the drive shafts 7 and 13 facilitates large adjusting paths for the swivelling movement of the pile stops 4 and for the linear movement of the collecting fingers 10, with relatively small angular turns of the drive shafts 7 and 13, which are effected by motorization.

The foregoing is a description corresponding in substance to German Application P 39 37 944.2, dated Nov. 15, 1989, the International priority of which is being claimed for the instant application, and which is hereby made part of this application. Any material discrepancies between the foregoing specification and the aforementioned corresponding German application are to be resolved in favor of the latter.

I claim:

1. Sheet delivery for a sheet-fed printing machine having fold-away pile stops for engagement by a leading edge of a sheet travelling from the sheet-fed printing machine to a location above a sheet pile, and removable collecting fingers insertable substantially rectilinearly for a brief period above the sheet pile so as to extend from the leading edge of the sheet, parallel to the plane of the sheet, for forming an auxiliary pile, a swivel shaft oriented parallel to the plane of the sheet and carrying the pile stops, and corresponding drive members for folding the pile stops away and folding them out again in accordance with an inserting movement and a withdrawal movement, respectively, of the collecting fingers, a first motorized drive for moving the pile stops, and a second motorized drive for moving the collecting fingers, each of said first and second motorized drives being disposed on a respective one of two machine sides of the sheet delivery, coaxially mounted first and second drive shafts disposed transversely to the direction of travel of the sheet, first transmission means operatively connecting said first motorized drive with said first drive shaft for rotating said first drive shaft, said first transmission means being disposed on one of said machine sides, and second transmission means operatively connecting said second motorized drive with said second drive shaft for rotating said second drive shaft and thereby guidingly displacing said collecting fingers substantially rectilinearly, said second transmission means being disposed on the other of said machine sides, and switching means for said first and second motorized drives for independently driving said first and second drive shafts individually, as well as for correspondingly driving said first and second drive shafts in mutual dependence.

2. Sheet delivery according to claim 1 including a first frame wall located at said one machine side, said first drive shaft being mounted in said first frame wall and having a first journal bearing wherein one end of said second drive shaft is mounted coaxially with said first drive shaft, and a second frame wall located at said other machine side and having a second journal bearing therein for supporting the other end of said second drive shaft.

3. Sheet delivery according to claim 2, wherein said first journal bearing is common to both said first and said second drive shafts, said first journal bearing being disposed directly adjacent to said first frame wall.

4. Sheet delivery according to claim 1, wherein said motorized drives are pneumatic cylinders of substantially like dimensions.

5. Sheet delivery according to claim 1, including a support beam connecting the collecting fingers to one another, said support beam being movably guidable rectilinearly, parallel to the plane of a topmost sheet in the sheet pile, and an articulating lever connecting said support beam to said second drive shaft.

* * * * *